US007131673B2

(12) United States Patent
Cherry et al.

(10) Patent No.: US 7,131,673 B2
(45) Date of Patent: Nov. 7, 2006

(54) ELECTROMECHANICAL KEEPER

(75) Inventors: Hitesh Cherry, Harrisburg, PA (US); Clive Anthony Morgan, Stourport on Severn (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/413,793

(22) Filed: Apr. 14, 2003

(65) Prior Publication Data

US 2003/0227181 A1 Dec. 11, 2003

Related U.S. Application Data

(60) Provisional application No. 60/372,482, filed on Apr. 14, 2002, provisional application No. 60/452,653, filed on Mar. 6, 2003.

(51) Int. Cl.
*E05B 15/02* (2006.01)

(52) U.S. Cl. ..... 292/341.16; 292/341.15

(58) Field of Classification Search ..... 292/341.15, 292/341.16, 340, 201
See application file for complete search history.

(56) References Cited

U.S. PATENT DOCUMENTS

| | | | | |
|---|---|---|---|---|
| 2,767,011 | A | 10/1956 | Buckley | |
| 3,543,547 | A | 12/1970 | Sugiyama | |
| 4,015,869 | A | 4/1977 | Horvath | |
| 4,056,277 | A | 11/1977 | Gamus et al. | |
| RE30,263 | E * | 4/1980 | Horvath | 292/341.16 |
| 4,616,865 | A | 10/1986 | Mackle | |
| 4,867,496 | A | 9/1989 | Thomes | |
| 4,969,343 | A | 11/1990 | Luker | |
| 4,995,248 | A | 2/1991 | Liu | |
| 5,042,857 | A * | 8/1991 | Burrows et al. | 292/341.16 |
| 5,076,625 | A | 12/1991 | Oxley | |
| 5,219,196 | A * | 6/1993 | Luker | 292/341.16 |
| 5,690,373 | A | 11/1997 | Luker | |
| 5,825,288 | A * | 10/1998 | Wojdan | 340/542 |
| 5,829,799 | A * | 11/1998 | Yamagishi et al. | 292/201 |
| 5,850,753 | A * | 12/1998 | Varma | 70/278.7 |
| 5,934,720 | A * | 8/1999 | Karalius | 292/341.16 |
| 5,943,888 | A * | 8/1999 | Lawson | 70/278.7 |
| 6,109,674 | A * | 8/2000 | Bartel et al. | 292/337 |
| 6,125,673 | A | 10/2000 | Luker | |
| 6,232,684 | B1 * | 5/2001 | Haag et al. | 310/68 R |
| 6,314,773 | B1 * | 11/2001 | Miller et al. | 70/303 A |
| 6,327,879 | B1 * | 12/2001 | Malsom | 70/97 |
| 6,457,753 | B1 * | 10/2002 | Wegge | 292/216 |
| 2002/0144525 | A1 | 10/2002 | Luker | |

FOREIGN PATENT DOCUMENTS

| | | |
|---|---|---|
| AU | A-13493/95 | 2/1994 |
| AU | 200031311 A1 | 5/2000 |

(Continued)

*Primary Examiner*—Gary Estremsky
(74) *Attorney, Agent, or Firm*—Paul & Paul

(57) ABSTRACT

An electromechanical keeper is disclosed that includes a base plate adapted for being mounted to a flat surface, a catch member pivotally supported by the base plate, and a solenoid having a solenoid shaft. The catch member is adapted to engage the pawl of a latch when the catch member is the closed position and the catch member is not engageable by the latch pawl when the catch member is in the open position. The solenoid shaft engages a cavity or bore in the catch member to retain the catch member in the closed position. The solenoid shaft disengages from the cavity or bore in the catch member to allow the catch member to rotate to the open position when the solenoid is energized.

65 Claims, 15 Drawing Sheets

FOREIGN PATENT DOCUMENTS

| | | | |
|---|---|---|---|
| AU | 200066599 | A1 | 10/2000 |
| AU | 200066674 | A1 | 10/2000 |
| AU | 200165498 | A1 | 8/2001 |
| GB | 2 251 024 | | 6/1992 |
| GB | 2 293 204 | A | 3/1996 |
| GB | 2 351 998 | A | 1/2001 |
| GB | 2 352 000 | A | 1/2001 |

* cited by examiner

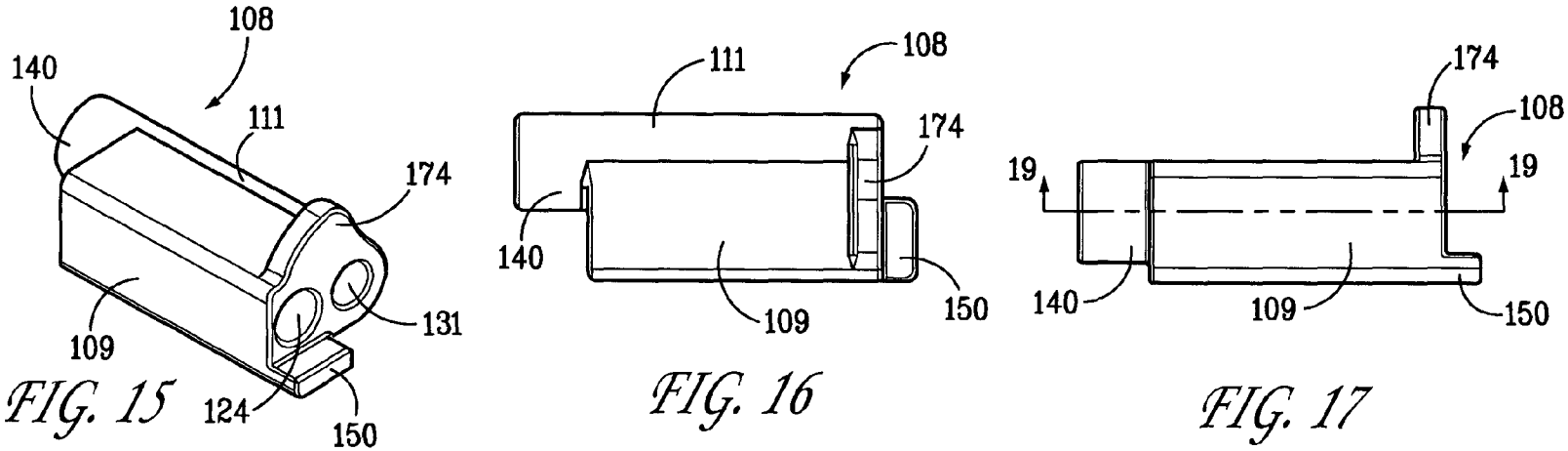
FIG. 15
FIG. 16
FIG. 17
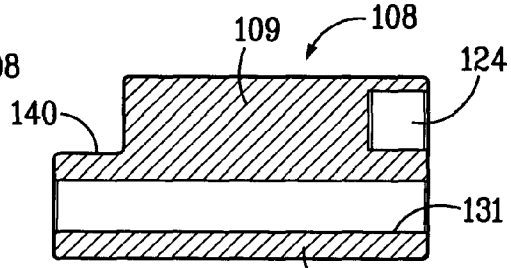
FIG. 18
FIG. 19
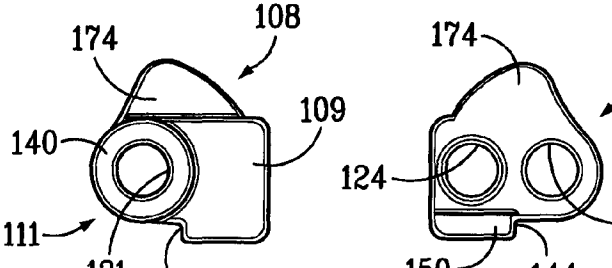
FIG. 20
FIG. 21

FIG. 48
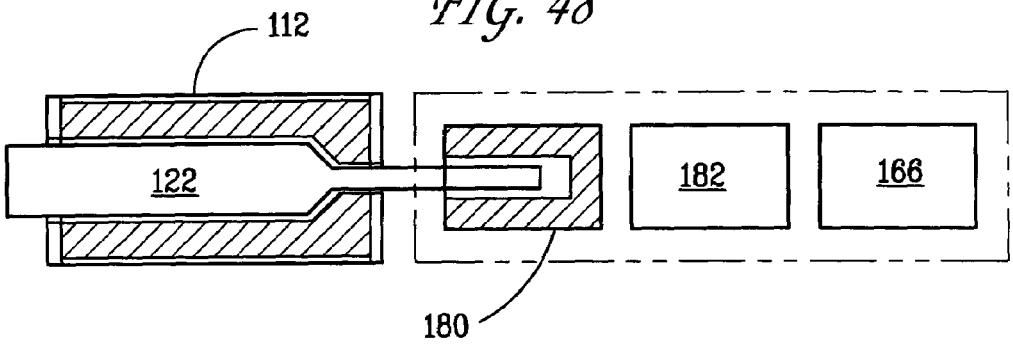
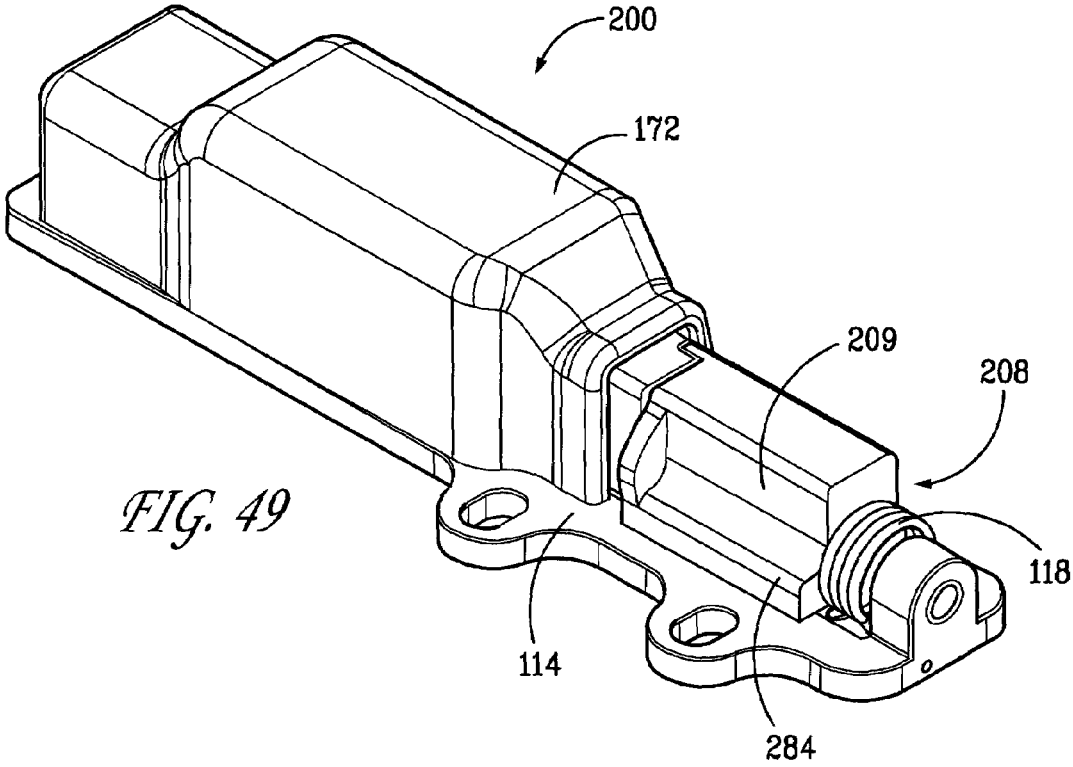
FIG. 49

ELECTROMECHANICAL KEEPER

CROSS REFERENCE TO RELATED APPLICATIONS

This application claims the benefit of the priority of U.S. Provisional Patent Application Ser. No. 60/372,482, filed on Apr. 14, 2002 and U.S. Provisional Patent Application Ser. No. 60/452,653, filed on Mar. 6, 2003. The entire disclosures of both these applications are incorporated herein by reference.

BACKGROUND OF THE INVENTION

1. Field of the Invention

The present invention relates to an electromechanical keeper for use with a slam-action latch.

2. Description of the Prior Art

Slam-action latches are used to releasably secure panels, covers, doors, electronic modules, and the like to other structures such as compartments, containers, door frames, other panels, frames, racks, etc. Slam-action latch as used herein refers to any type of latch having a pawl biased toward the closed or extended position. When, for example, a door to which the slam-action latch is mounted is slammed shut, the pawl is automatically moved to the retracted or open position by contact with a keeper or doorframe to allow the door to move to the fully closed position. Once the door is in the fully closed position the pawl returns to the closed or extended position to engage a keeper or door frame and thereby secure the door in the fully closed position. Hence the term slam-action latch.

Although keepers for use with slam-action latches are known in the art, none offers the advantages of the present invention. The advantages of the present invention will be apparent from the attached description and drawings.

SUMMARY OF THE INVENTION

The present invention is directed to an electromechanical keeper for use with a slam-action latch. Furthermore, the electromechanical keeper of the present invention is adapted to be surface-mountable such that it can be mounted to the surface of a doorframe without requiring a recess in the doorframe and with little or no preparation of the surface to which the electromagnetic keeper of the present invention is to be mounted.

BRIEF DESCRIPTION OF THE DRAWINGS

FIGS. 15–21 are different views of the catch member of the electromechanical keeper of the present invention.

FIG. 48 is a schematic view of a circuit board and micro-switch that can be used with the electromechanical keeper of the present invention.

FIG. 49 is a perspective view showing an alternative embodiment of the electromechanical keeper of the present invention having a modified catch member.

Similar reference characters denote corresponding features consistently throughout the attached drawings.

DETAILED DESCRIPTION OF THE PREFERRED EMBODIMENTS

Figure 1:
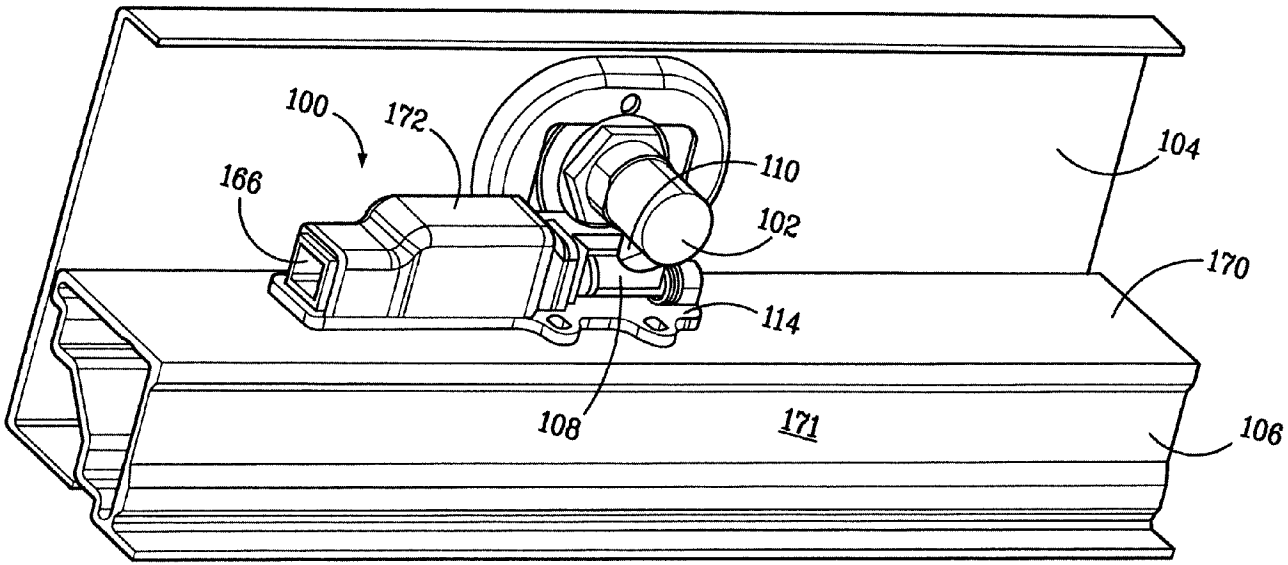
FIG. 1 is an environmental view showing a door having a slam-action latch mounted thereto and a doorframe with the electromechanical keeper of the present invention installed thereto, with the door being in the closed position and the electromechanical keeper being in the closed configuration.

Slam-action latches are latches that have pawls that automatically move to allow closing of a door or the like and that automatically move to a closed position behind a keeper or the like to secure the door in the closed condition. All these actions are accomplished as a result of slamming the door shut, hence the term "slam-action" latch. Examples of slam-action latches are disclosed in U.S. Pat. No. 4,978,152, the entire disclosure of which is incorporated herein by reference.

In the illustrative installation shown in the figures, the present invention is an electromechanical keeper 100 for use with a slam-action latch 102. The slam-action latch 102 is installed to the door 104 and the keeper 100 is installed to the doorframe 106. The keeper 100 includes a solenoid 112, a catch member 108, a base plate 114, a compression spring 116, a torsion spring 118 and a pivot pin 120. The catch member 108 is roughly in the shape of a rectangular parallelepiped having an elongated cylinder joined to one of its longer sides with the longitudinal axes of the rectangular parallelepiped and the elongated cylinder being parallel. The rectangular parallelepiped forms the pawl-engaging portion 109 of the catch member 108. In the closed position, the catch 108 interferes with the latch pawl 110, causing the latch pawl 110 to automatically move to allow closing of the door and to automatically move to a closed position behind the pawl-engaging portion 109, as the door 104 is slammed shut. Thus, the door can be secured in the closed position.

The portion 111 of the catch member 108 that is formed by the elongated cylinder has a longitudinal bore 131. The base plate 114 has a pair of pillars 132 and 134 that are spaced apart from one another. Each of the pillars 132 and 134 has a first bore 136 and 138, respectively. The bores 136 and 138 are in alignment with one another. The catch member 108 fits between the pillars 132 and 134 such that the bore 131 is in alignment with the bores 136 and 138. The pivot pin 120 is positioned through the bore 131 with its ends supported by the bores 136 and 138 such that the pivot pin 120 pivotally supports the catch member 108. The portion 111 of the catch member 108 is longer than the portion 109 of the catch member 108, thereby forming the cylindrical projection 140. The projection 140 is designed to accommodate the torsion spring 118, such that the coils of the torsion spring 118 are positioned around the projection 140. One arm 142 of the torsion spring 118 is positioned in a notch 144 of the catch member 108. The second arm 146 of the torsion spring 118 is positioned in the angle between the pillar 134 and the flat plate portion 148 of the base plate 114. The torsion spring 118 biases the catch member 108 toward the closed position shown in FIGS. 1, 2, and 26–39, such that the catch member 108 tends to return to the closed position whenever the catch member is displaced toward the open position and then released.

The catch member 108 also has a second projection 150 that abuts the pillar 132 when the catch member 108 is in the closed position. The interference between the projection 150 and the pillar 132 prevents the catch member 108 from over-rotating or overshooting the closed position as the catch member 108 rotates from the open position toward the closed position.

The pillar 132 has a second bore 152 that is parallel to, but spaced apart from, the first bore 136. The bore 152 is in alignment with a cavity or bore 124 in the catch member 108 when the catch member 108 is in the closed position.

The base plate 114 includes a structure 156 that is adapted for attachment or mounting of the solenoid 112 to the base plate 114. In the illustrated embodiment the mounting structure 156 includes a pair of parallel flanges 158 and 160 that project perpendicularly from the surface of the flat plate portion 148 of the base plate 114. The mounting structure 156 also includes a raised platform 162 positioned between the flanges 158 and 160.

The solenoid 112 includes a solenoid body 154, that houses the magnetic coils of the solenoid 112, and a solenoid shaft 122 that can reciprocate linearly relative to the solenoid body 154. The operation of the solenoid 112 is well known and is not discussed herein in detail. When the solenoid 112 is energized the solenoid shaft 122 linearly moves relative to the solenoid body 154 from an extended position to a retracted position. The solenoid shaft 122 includes an annular flange 164. The compression spring 116 is provided intermediate the flange 164 and the solenoid body 154 and acts to bias the solenoid shaft 122 toward the extended position.

The solenoid shaft 122 may be of one-piece construction or the shaft 122 may be built up from two or more pieces that are joined together so that they move as a single unit in operation.

The solenoid body 154 is positioned between the flanges 158 and 160 and securely attached to the base plate 114 such that the solenoid body 154 remains securely in place relative to the base plate 114 during operation of the electromechanical keeper 100. With the solenoid body 154 secured to the base plate 114, the solenoid shaft 122 will be in alignment with the bore 152. Furthermore, the solenoid shaft 122 will be in alignment with the cavity 124 when the catch member 108 is in the closed position.

The extended and retracted positions of the solenoid shaft 122 correspond to the open and closed positions of the solenoid shaft 122, respectively. When the catch member 108 is in the closed position and the solenoid shaft 122 is in the closed position, the solenoid shaft 122 engages cavity 124 and thereby prevents any rotational or pivotal movement of the catch member 108. When the solenoid 112 is energized the solenoid shaft 122 is retracted to the open or retracted position. The solenoid shaft 122 is completely withdrawn from the cavity 124 when the solenoid shaft 122 is in the open position, and the catch member 108 can rotate toward the open position of the catch member 108 that is illustrated in FIGS. 40–47 if the force due to the torsion spring 118 is overcome.

The catch member 108 also has an extension 174 that has a surface that is flush with the opening of the cavity 124. The extension 174 functions to keep the solenoid shaft 122 in the retracted or open position when the catch member 108 is out of its closed position. This arrangement prevents the solenoid shaft 122 from moving to its closed or extended position before the catch member 108 is back in its closed position. Thus the extension 174 prevents the solenoid shaft 122 from interfering with the pivotal movement of the catch member 108 back to its closed position.

Figure 30:
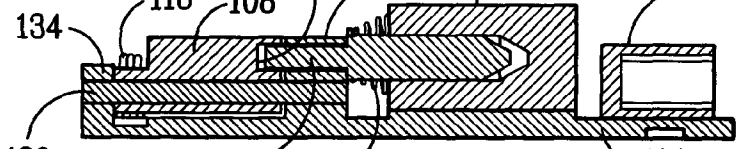
Figure 34:
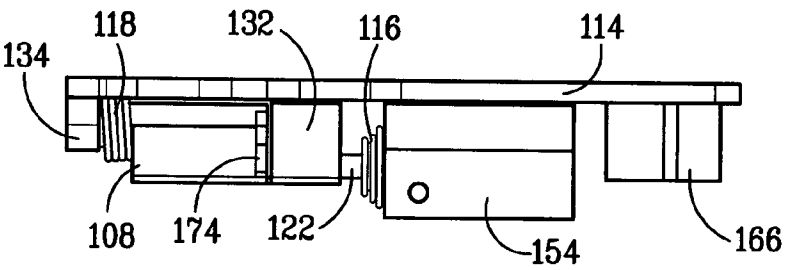
FIGS. 33–39 are different views of the electromechanical keeper of the present invention with the protective cover removed, wit the solenoid shaft in the open position, and with the catch member in the closed position.
Figure 36:
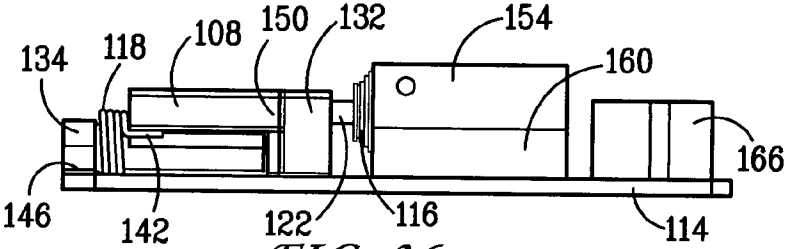
Figure 39:
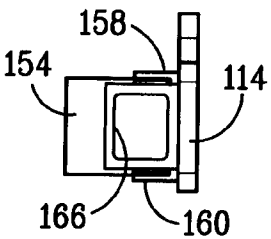
Figure 38:
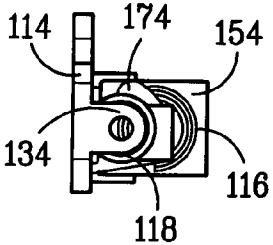
Figure 33:
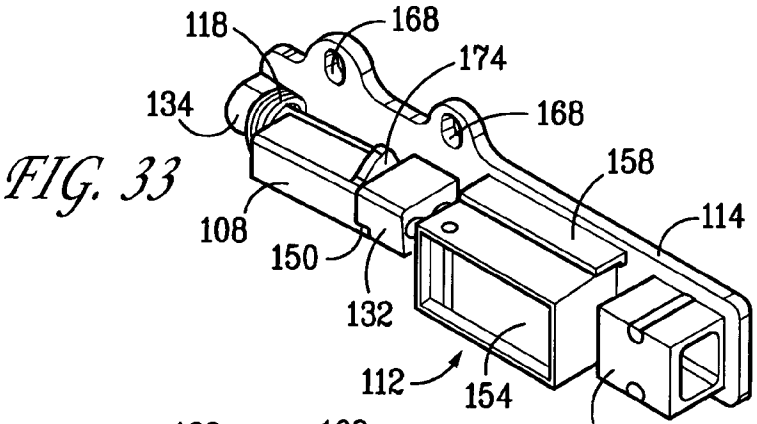
Figure 35:
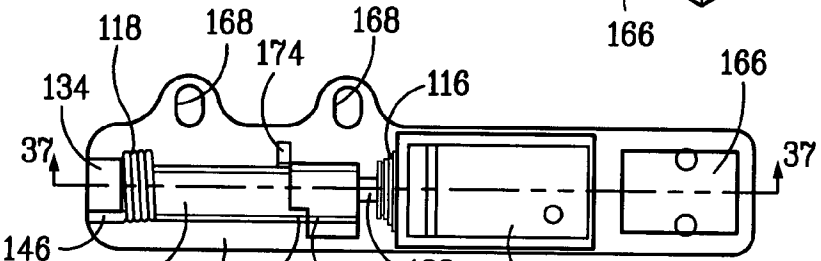
Figure 37:
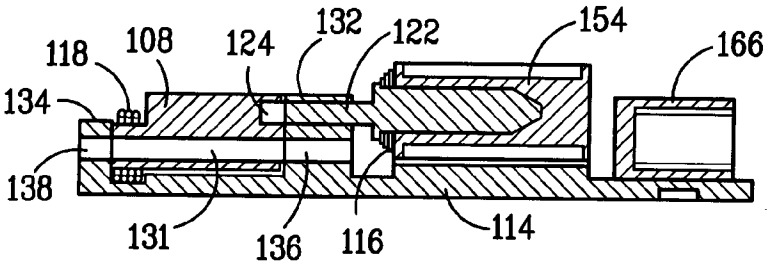
Figure 40:
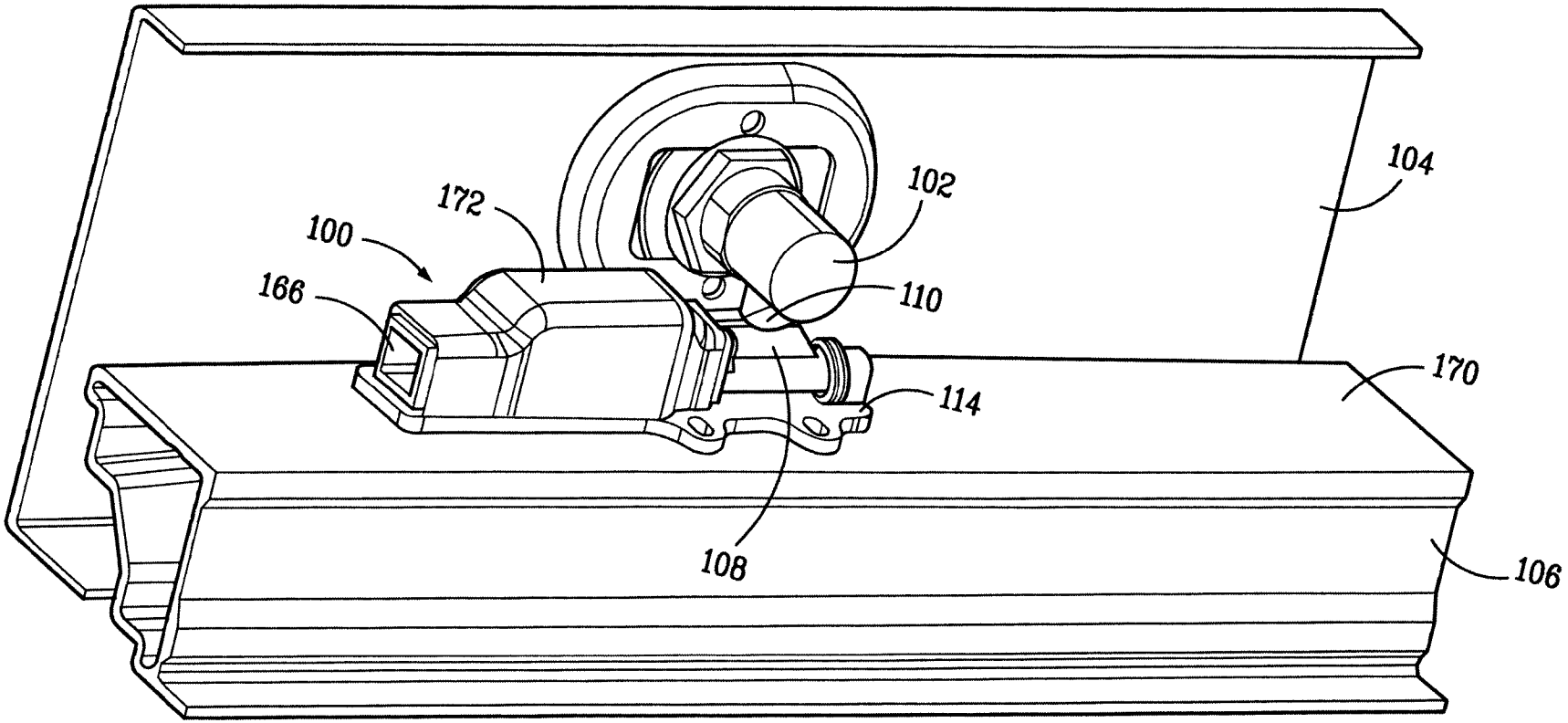
FIG. 40 is an environmental view showing a door having a slam-action latch mounted thereto and a doorframe with the electromechanical keeper of the present invention installed thereto, with the door being opened and the electromagnetic keeper being in the open configuration.
Figure 41:
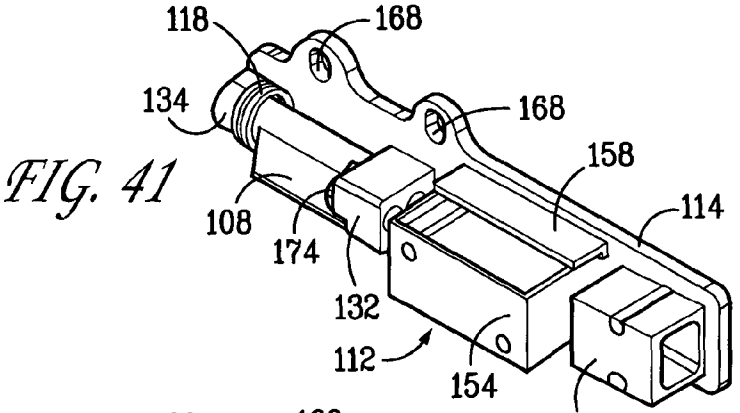
FIGS. 41–47 are different views of the electromechanical keeper of the present invention with the protective cover removed, with the solenoid shaft in the open position, and with the catch member in the open position.
Figure 42:
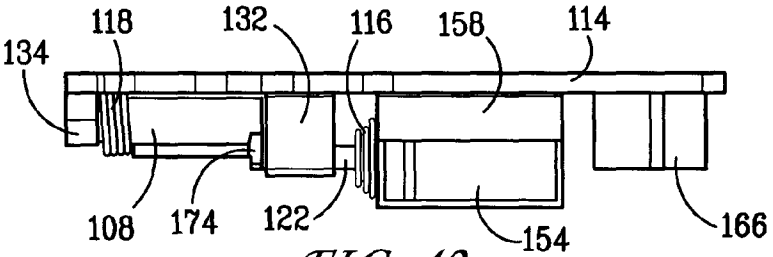
Figure 43:
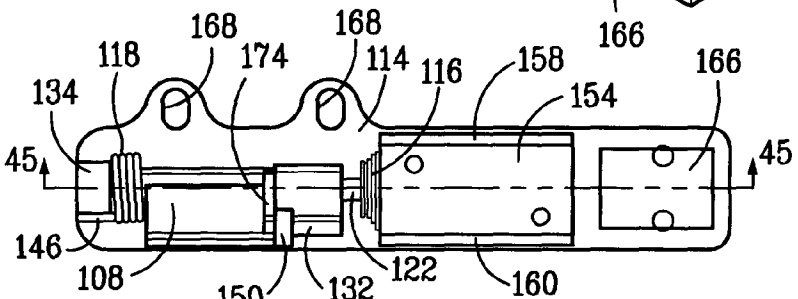
Figure 44:
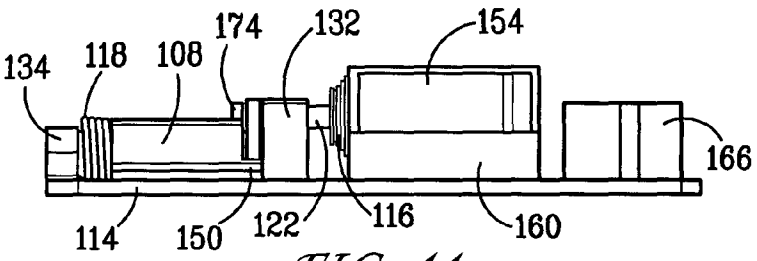
Figure 45:
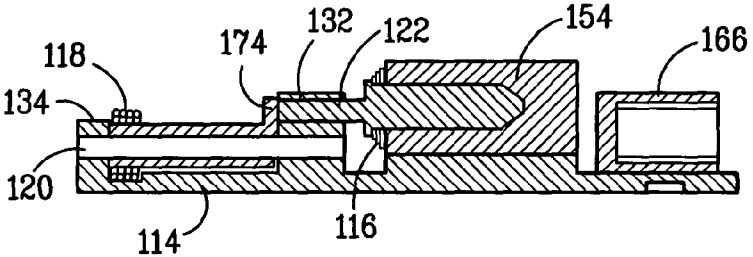
Figure 46:
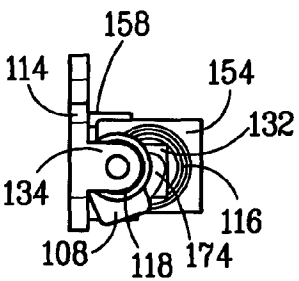
Figure 47:
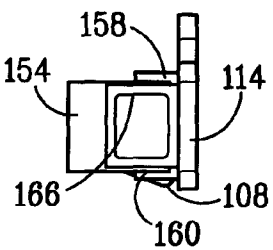

As is readily apparent from FIGS. 30, 37, and 45, the longitudinal axis of the pivot pin 120, and accordingly the axis of rotation of the catch member 108, and the longitudinal axis of the solenoid shaft 122 are directed parallel to one another.

In the illustrated embodiment, the electromechanical keeper 100 is provided with an RJ12 receptacle 166 for the connection of the power and/or control signal lines using a matching RJ12 jack (similar to a telephone jack and not shown). The appropriate conductors within the receptacle 166 are connected to the solenoid 112 by wires (not shown) to thereby provide power and/or control signals to the solenoid 112. The receptacle 166 is attached to the flat plate portion 148 of the base plate 114 with the solenoid body 154 positioned intermediate the receptacle 166 and the pillar 132.

The base plate 114 is adapted to be surface-mountable to any flat surface with little or no preparation of the surface and without a need to provide a recess or cavity in the surface. For example, the base plate 114 can be mounted to the underlying surface by using adhesives, by welding, by soldering or brazing, or by using fasteners such as screws, nuts and bolts, or rivets. In the illustrated embodiment, the flat plate portion 148 of the base plate 114 is provided with mounting holes 168. In the illustrated embodiment, the base plate 114 is mounted to the flat inner side 170 of the doorframe 106. The only surface preparation required is to drill holes in the side 170 of doorframe 106 that correspond to the mounting holes 168. Some of the mounting holes 168 are elongated or are in the form of slots to allow some degree of positional adjustment for the base plate 114 once the holes in the side 170 of the doorframe 106 are drilled.

In addition, the electromechanical keeper 100 is provided with a protective cover 172 that is best illustrated in FIGS. 3–8. The protective cover 172 covers the receptacle 166, the solenoid 112, the electrical circuitry between the receptacle 166 and the solenoid 112, and the gap between the solenoid body 154 and the pillar 132. The protective cover 172 prevents corrosion and foreign matter from interfering with the operation of the electromechanical keeper 100. The protective cover 172 can be secured in place using a variety of means such as adhesives, welding, fasteners, or by providing a snap-fit between the protective cover 172 and the base plate 114.

Figure 2:
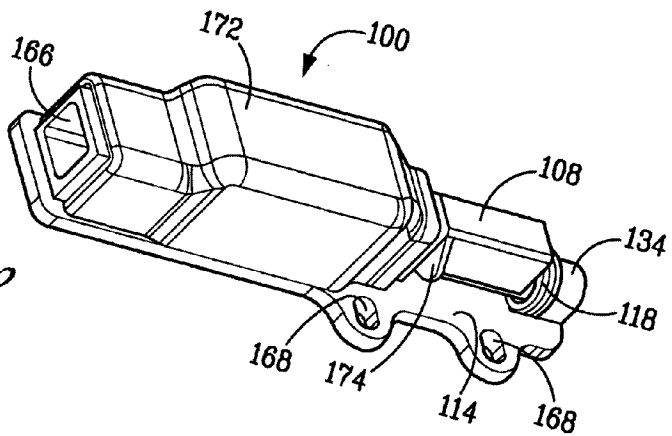
FIG. 2 is a perspective view showing the electromechanical keeper of the present invention in isolation.
Figure 3:
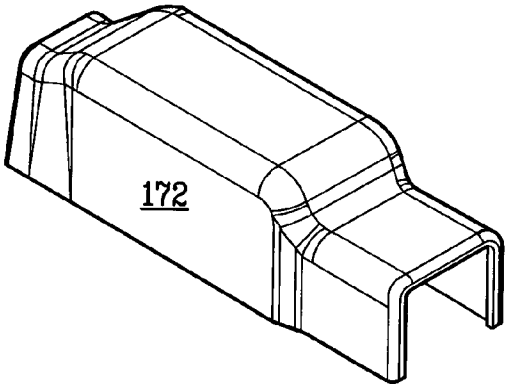
FIGS. 3–8 are different views of the protective cover of the electromechanical keeper of the present invention.
Figure 4:
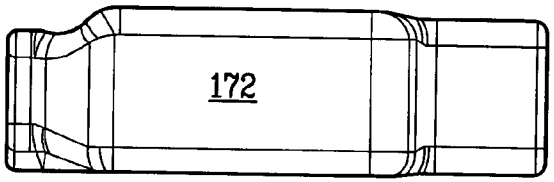
Figure 5:
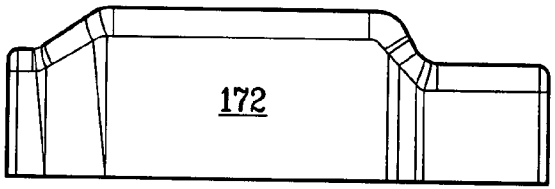
Figure 6:
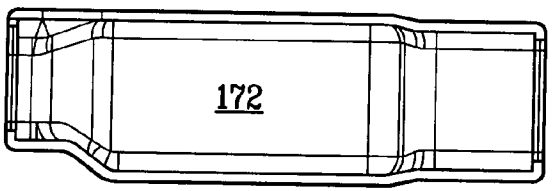
Figure 7:
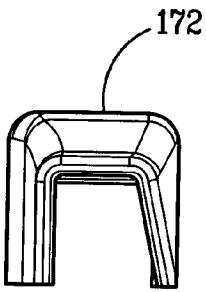
Figure 8:
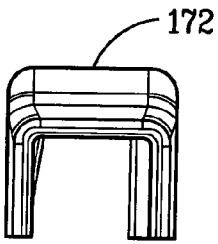
Figure 10:
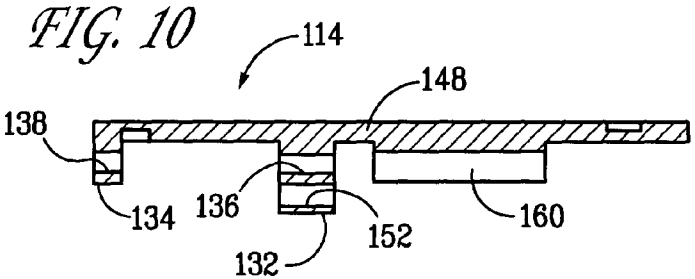
FIGS. 9–14 are different views of the base plate of the electromechanical keeper of the present invention.
Figure 11:
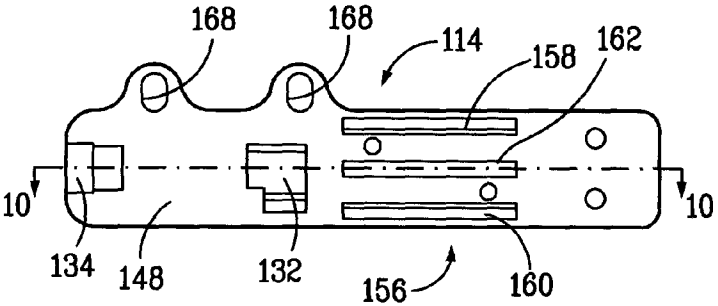
Figure 14:
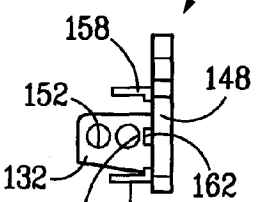
Figure 13:
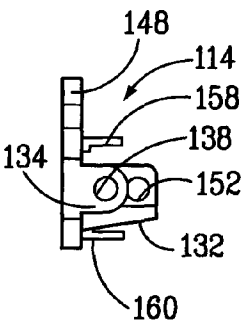
Figure 9:
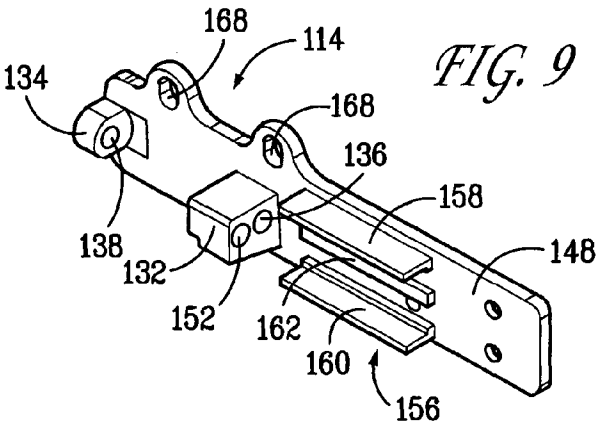
Figure 12:
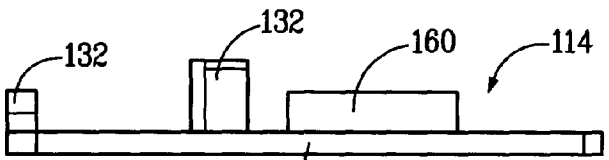
Figure 23:
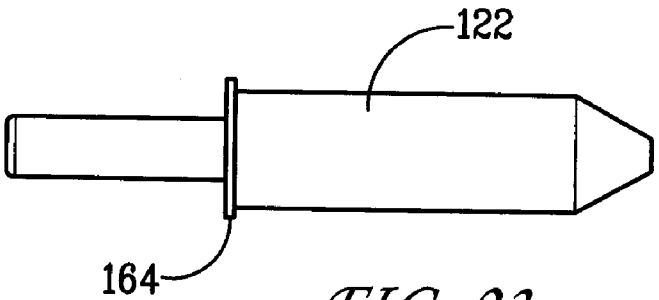
FIGS. 22–25 are different views of the solenoid shaft of the electromechanical keeper of the present invention.
Figure 25:
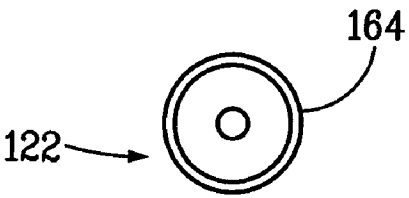
Figure 22:
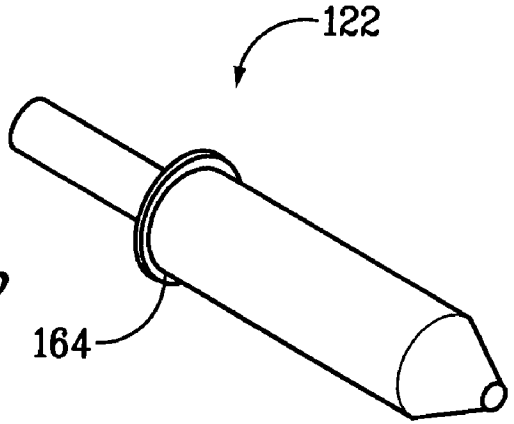
Figure 24:
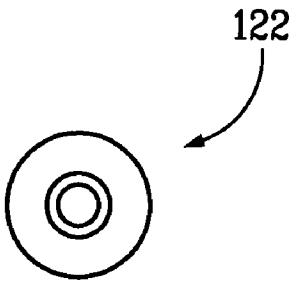
Figure 27:
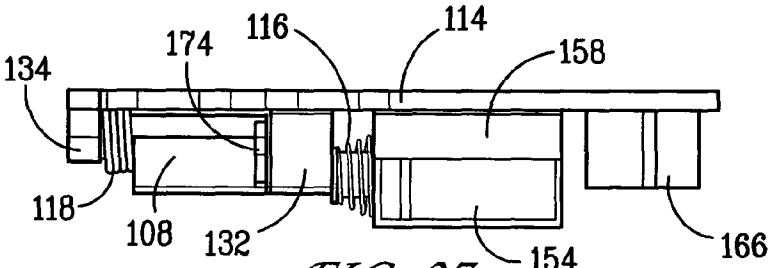
FIGS. 26–32 are different views of the electromechanical keeper of the present invention with the protective cover removed, with the solenoid shaft in the closed position, and with the catch member in the closed position.
Figure 29:
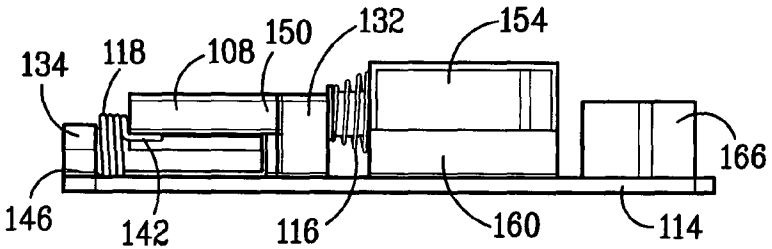
Figure 32:
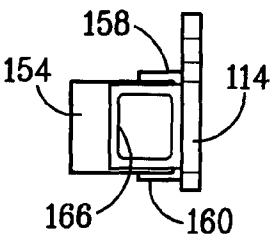
Figure 31:
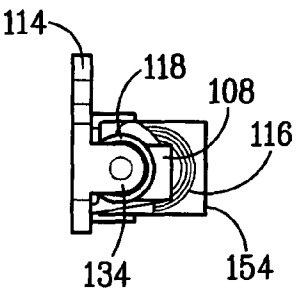
Figure 26:
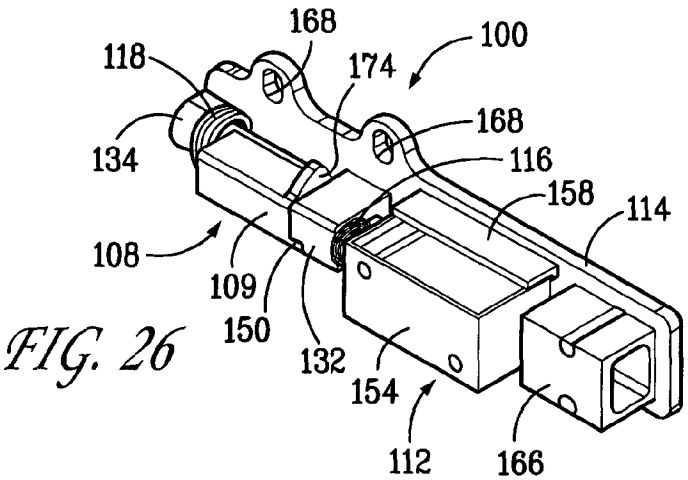
Figure 28:
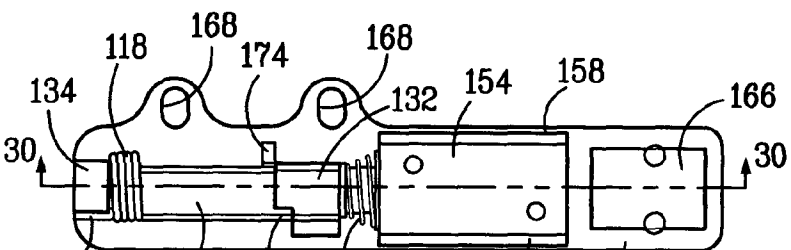

The operation of the electromechanical keeper 100 will now be described with the door 104 closed and with the solenoid 112 not energized. The electromechanical keeper 100 will be mounted to the doorframe 106 as illustrated in FIGS. 1 and 2. The catch member 108 will initially be in the closed position because the torsion spring 118 biases the catch member 108 to the closed position. When the solenoid 112 is not energized, the compression spring 116 biases the solenoid shaft 122 into engagement with the cavity 124 of the catch member 108 and the solenoid shaft 122 will in fact extend into the cavity 124. In this configuration the catch member 108 is prevented from rotating or pivoting out of its closed position and the catch member 108 will behave essentially like a fixed keeper. If a user has a key to the latch 102, the user can operate the latch 102 and open the door 104 in the conventional manner. Once the door is open, the user can also close the door in the conventional manner. Because the solenoid shaft 122 extends into the cavity 124, the catch member 108 will remain in its closed position as the door 104 is closed. In the closed position, the catch 108 interferes with the latch pawl 110, causing the latch pawl 110 to automatically move to a retracted position to allow closing of the door. Once the door is fully closed, the latch pawl 110 automatically moves to the extended or closed position behind the pawl-engaging portion 109 of the catch member 108, as illustrated in FIG. 1, to thereby secure the door 104 in the closed position. The door 104 will then be locked and cannot be opened without operating the latch 102 or energizing the solenoid 112.

To unlock the door 104 electrically, the solenoid 112 is energized, which causes the solenoid shaft 122 to be retracted from the cavity 124. The catch member 108 can now rotate or pivot about pin 120. Even with the solenoid shaft 122 retracted, due to the force of the torsion spring 118, the catch member 108 will not rotate to its open position and the door 104 will remain closed. However, if the door 104 is pulled with sufficient force to overcome the force of the torsion spring 118 while the solenoid 112 is energized, the catch member 108 will rotate out of engagement with the latch pawl 110 and the door will open. When the catch member 108 is rotated out of engagement with the latch pawl 110, the catch member 108 will be in the open position illustrated best in FIG. 40. After the door 104 is open, the force of the torsion spring 118 will reset the catch member 108 back to its closed position. Then when the solenoid 112 is no longer energized, i.e. when the power to the solenoid is cut off, the solenoid shaft 122 will slide back into the cavity 124 and will lock the catch member 108 in the closed position. The door 104 can then be slammed shut to once again cause the door to be secured or locked in the closed position as has previously been described.

In one illustrative embodiment, the solenoid 112 is operated with a 25% duty cycle such that the solenoid is energized for 10 seconds to allow the door to be opened and then the solenoid is not energized again within the next 30 seconds. This method of operation prevents the solenoid 112 from overheating.

Referring to FIG. 48, a schematic view of a circuit board and micro-switch that can be used with the electromechanical keeper of the present invention can be seen. The micro-switch 180 is positioned such that it can be actuated by the solenoid shaft 122 when it reaches a fully open or retracted position. The micro-switch 180 communicates with the circuit board 182 that is supported by the base plate 114. The circuit board 182 also communicates with the solenoid 112 and the receptacle 166. The power supply to the solenoid is controlled by the circuit board 182 such that overheating of the solenoid is prevented. When the micro-switch 180 is actuated by the solenoid shaft 122 reaching the fully open or retracted position, a signal is generated to the circuit board 182 that indicates the time when energizing of the solenoid was initiated. The circuit board 182 can then control the power supplied to the solenoid 112 such that the solenoid is energized for a first predetermined period of time, e.g. 10 seconds, to allow the door to be opened and then the solenoid is not energized again within a following second predetermined period of time, e.g. the next 30 seconds, in order to prevent over heating of the solenoid.

Figure 50:
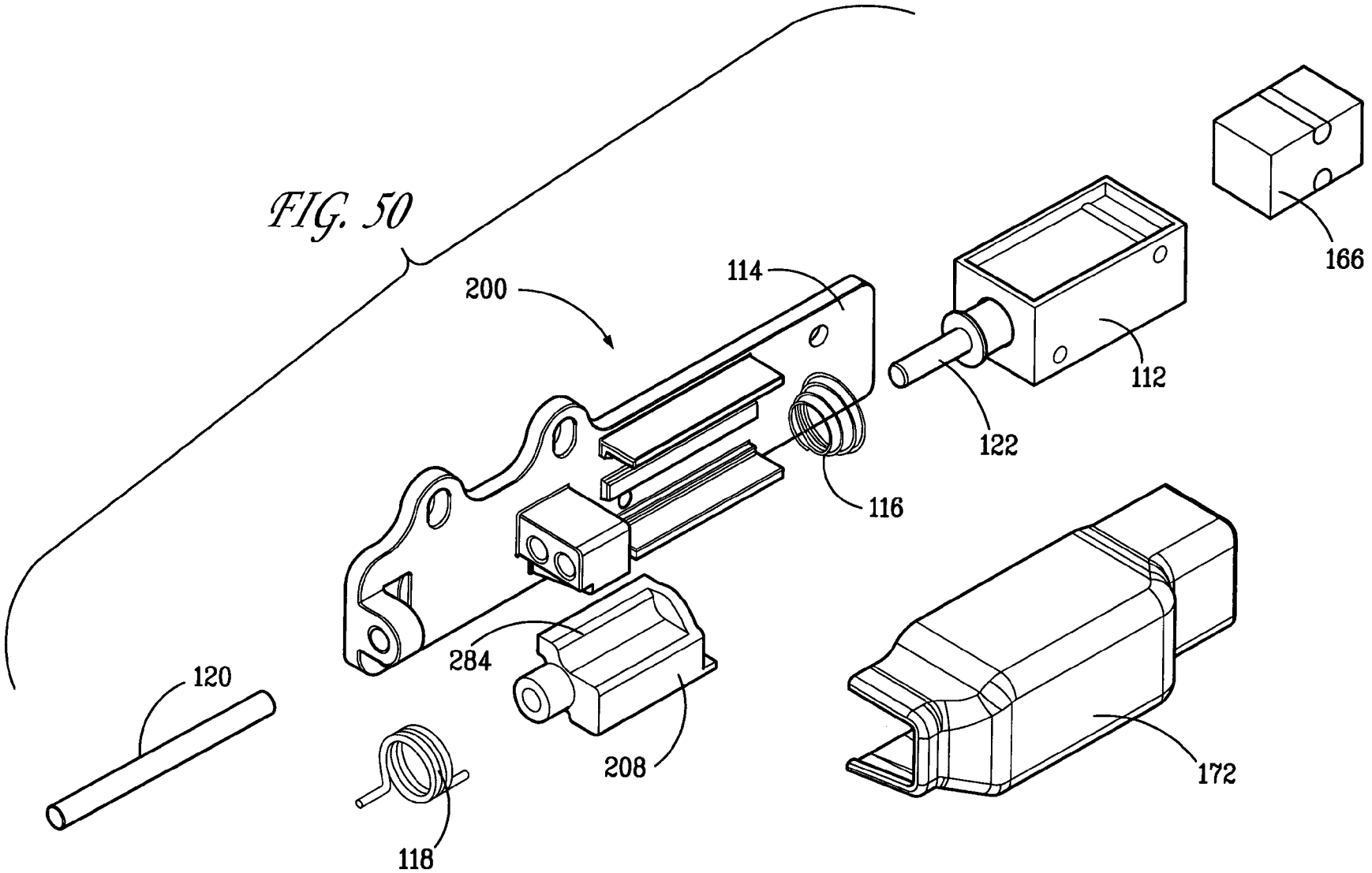
FIG. 50 is an exploded view showing an alternative embodiment of the electromechanical keeper of the present invention having a modified catch member.

Referring to FIGS. 49 and 50, an alternative embodiment of the electromechanical keeper of the present invention having a modified catch member can be seen. This embodiment 200 is essentially identical to the electromagnetic keeper 100 except for the modified catch member 208. The modified catch member 208 is essentially similar to the catch member 108 except that the catch member 208 is provided with the shelf or step 284. The shelf 284 projects outward from the catch member 208 substantially perpendicularly relative to the pawl-engaging portion 209 of the catch member 208. When the catch member 208 is in the open position, the shelf 284 is positioned such that the shelf 284 is in the approximate position of the pawl-engaging portion 209 of the catch member 208 in the closed position. Thus, when the catch member 208 is recessed within an opening in the doorframe, the shelf 284 blocks efforts to tamper with the catch member 208 by, for example, jamming or propping catch member 208 in the open position by inserting a foreign object in to the opening in the doorframe. In addition, the shelf 284 can aid in returning the catch member 208 to its closed position, for example, when friction between the catch member 208 and the solenoid shaft 122 is too excessive for the torsion spring 118 to overcome. This result is achieved by the impact of the pawl 110 of the latch 102 on the shelf 284 as the door is closing while the catch member 208 is in the open position.

Figure 51:
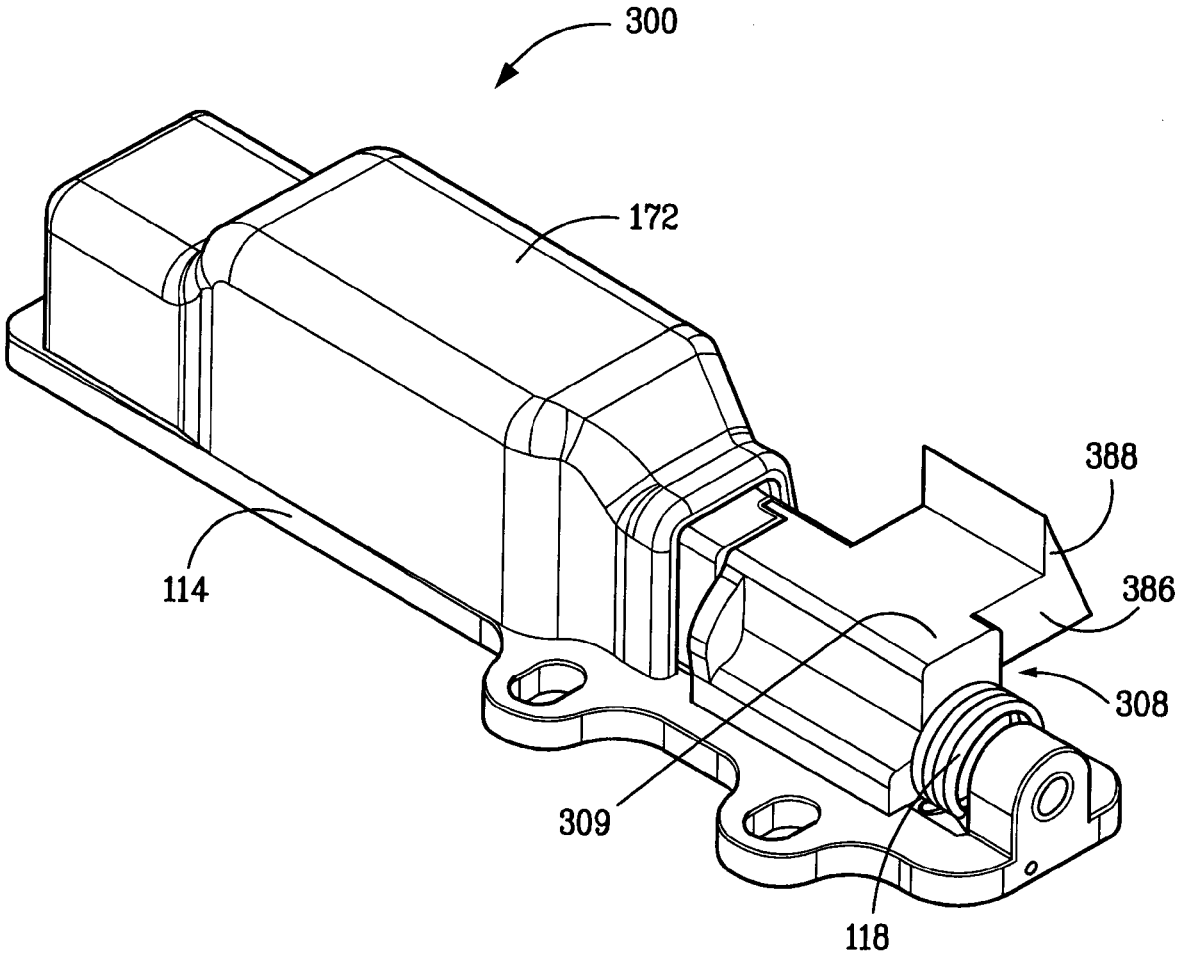
FIG. 51 is a perspective view showing an alternative embodiment of the electromechanical keeper of the present invention having an elongated catch member.
Figure 52:
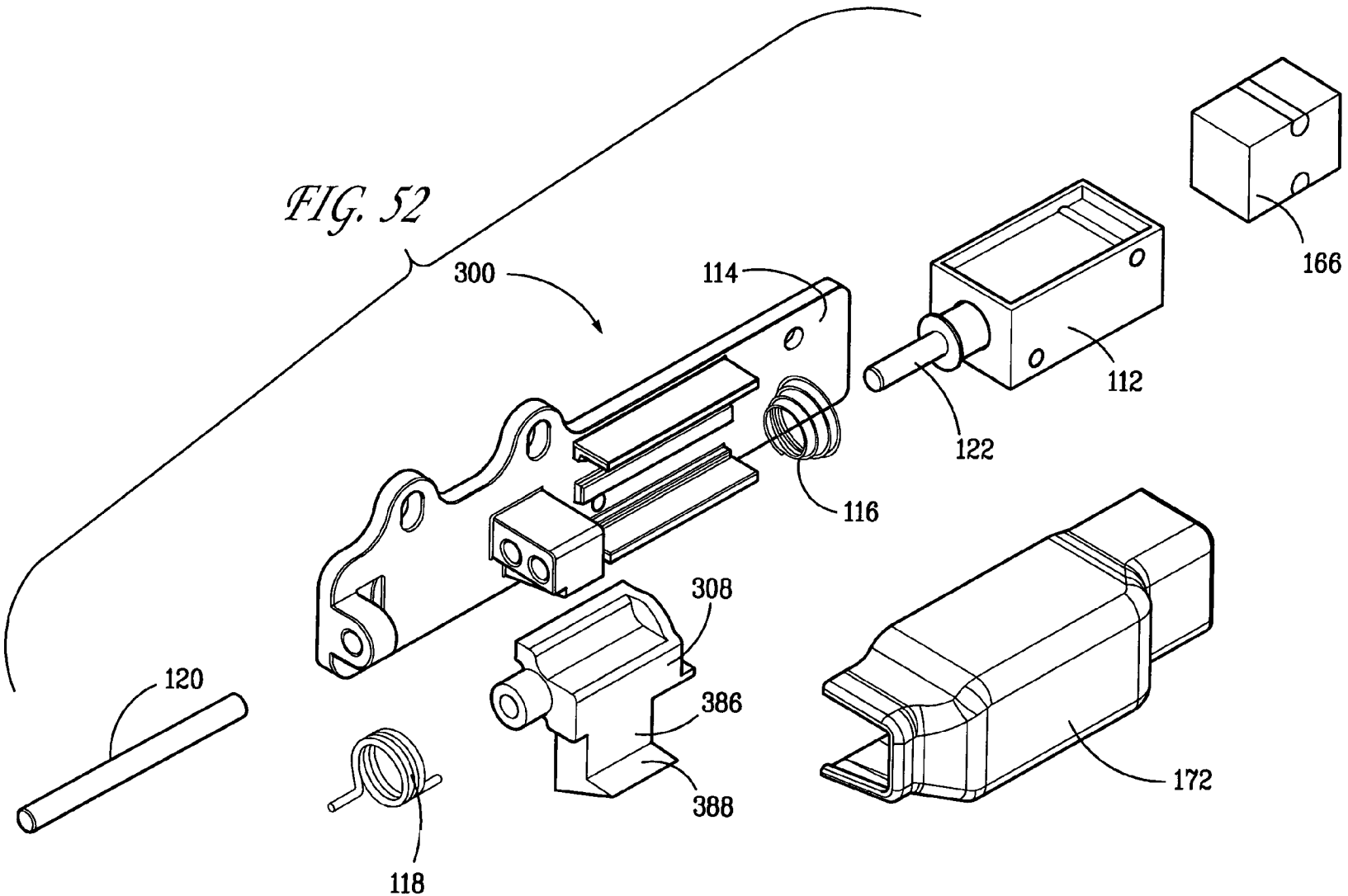
FIG. 52 is an exploded view showing an alternative embodiment of the electromechanical keeper of the present invention having an elongated catch member.

Referring to FIGS. 51 and 52, an alternative embodiment of the electromechanical keeper of the present invention having an elongated catch member can be seen. This embodiment 300 is essentially identical to the electromagnetic keeper 200 except for the modified catch member 308. The modified catch member 308 is essentially similar to the catch member 208 except that the catch member 308 is provided with an elongated catch portion 386 having a hook-like end portion 388. The elongated catch portion 386 is attached to the approximately parallelepiped body portion 309 of the catch member 308 such that the elongated catch portion 386 extends parallel to the base plate 114 and the pivot shaft 120 is positioned intermediate the base plate 114 and the elongated catch portion having the hook-like end portion 388, when the catch member 308 is in the closed position. The latch pawl 110 catches the hook-like end portion 388 to secure the door 104 in the closed position, when the catch member 308 is in the closed position. The design of the catch member 308 allows the electromechanical keeper to be mounted farther from the door 104 on the surface 170 of the doorframe 106, should this be necessary because of the geometry of the doorframe 106 or the door 104.

Figure 53:
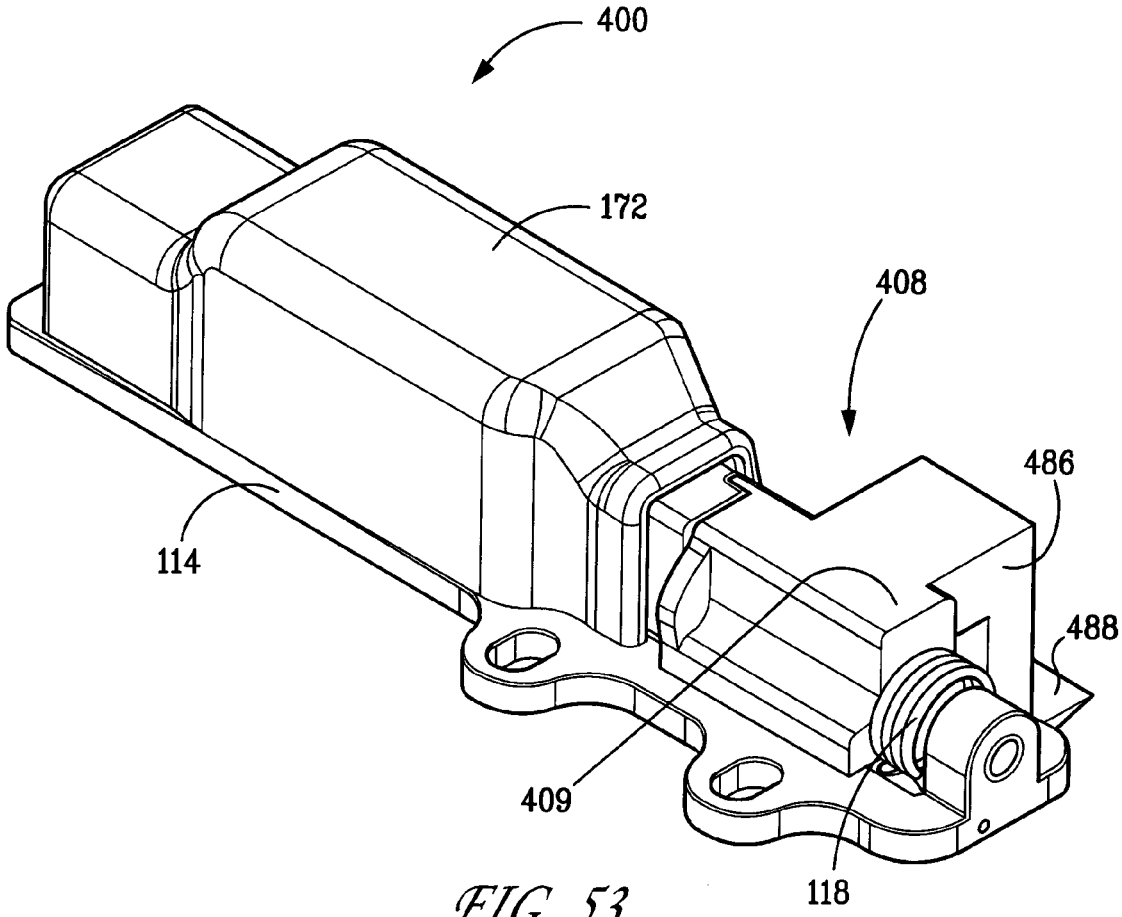
FIG. 53 is a perspective view showing an alternative embodiment of the electromechanical keeper of the present invention having an L-shaped catch member.
Figure 54:
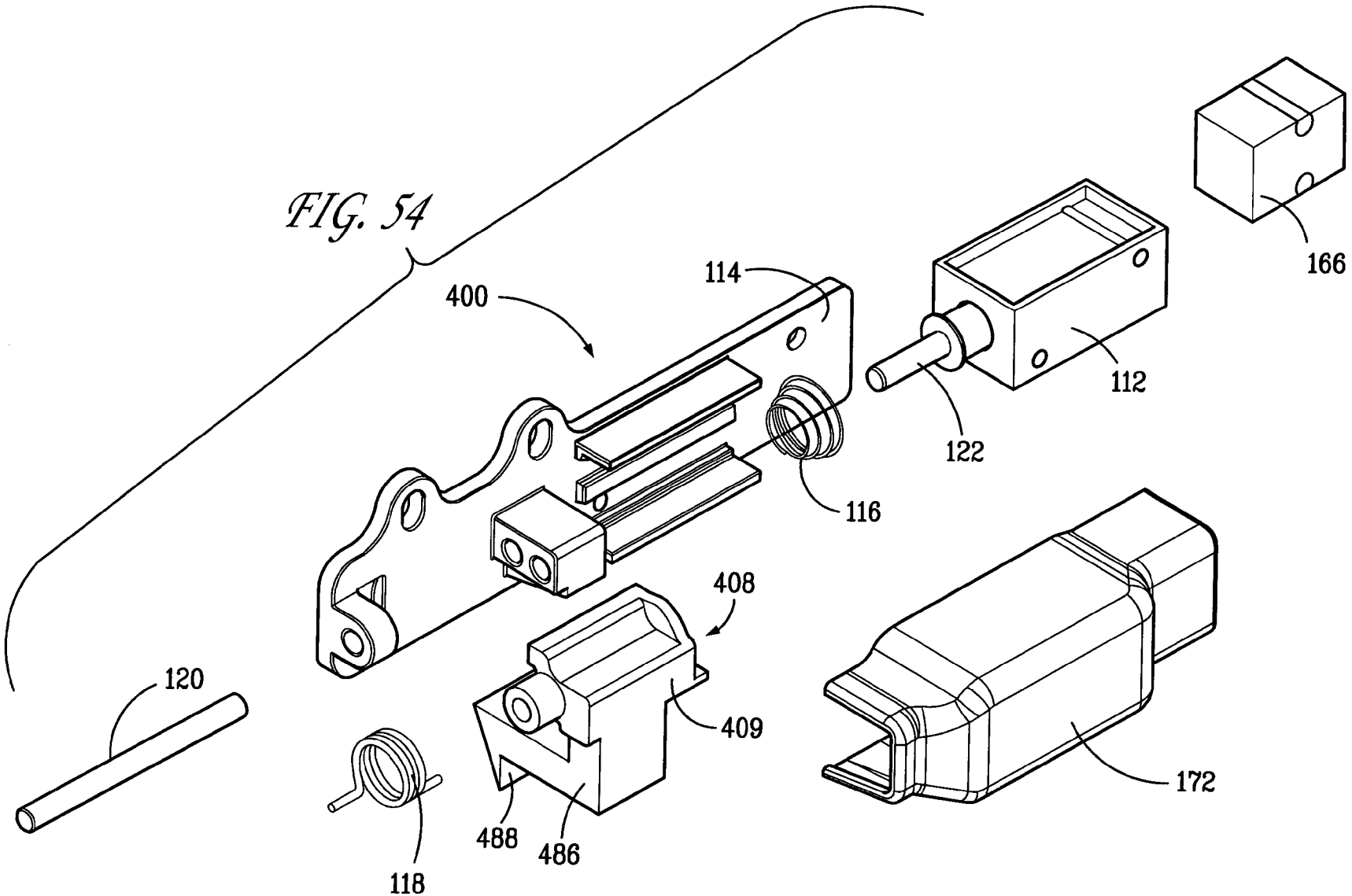
FIG. 54 is an exploded view showing an alternative embodiment of the electromechanical keeper of the present invention having an L-shaped catch member.

Referring to FIGS. 53 and 54, an alternative embodiment of the electromechanical keeper of the present invention having an L-shaped catch member can be seen. This embodiment 400 is essentially identical to the electromagnetic keeper 300 except for the modified catch member 408. The modified catch member 408 is essentially similar to the catch member 308 except that the catch member 408 is provided with an elongated catch portion 486 having a bend so as to have an L-shaped profile. The elongated catch portion 486 has a hook-like end portion 488 that functions similarly to the hook-like end portion 388. The elongated catch portion 486 is attached to the approximately parallelepiped body portion 409 of the catch member 408 such that the elongated catch portion 486 initially extends parallel to the base plate 114 and then bends at about a right angle in a direction toward the plane of the base plate 114. The pivot shaft 120 is positioned intermediate the base plate 114 and the attachment of the elongated catch portion 486 to the approximately parallelepiped body portion 409. The latch pawl 110 catches the hook-like end portion 488 to secure the door 104 in the closed position, when the catch member 408 is in the closed position illustrated in FIG. 53. The design of the catch member 408 allows the electromechanical keeper 400 to be mounted behind the doorframe 106 to the surface 171 of the doorframe 106, should this be necessary because of the geometry of the doorframe 106 or the door 104.

It is to be understood that the present invention is not limited to the embodiments disclosed above, but includes any and all embodiments within the scope of the appended claims.

The invention claimed is:

1. An electromechanical keeper comprising:

a base plate adapted for being mounted to an underlying surface;

a catch member pivotally supported by said base plate, said catch member being movable between open and closed positions, said catch member being adapted to engage a latch pawl of a latch when said catch member is in said closed position and said catch member not being engageable by the latch pawl when said catch member is in said open position, said catch member having a cavity, said cavity in said catch member having an opening, said catch member having an extension that has a surface that is flush with said opening of said cavity in said catch member; and a solenoid supported by said base plate, said solenoid having a solenoid shaft that is movable from an extended position to a retracted position responsive to said solenoid being energized, said solenoid shaft engaging said cavity in said catch member to thereby retain said catch member in said closed position when said solenoid shaft is in said extended position, said solenoid shaft being disengaged from said cavity in said catch member such that said catch member is free to move from said closed position to said open position when said solenoid shaft is in said retracted position, wherein said extension functions to prevent said solenoid shaft from interfering with pivotal movement of said catch member toward said closed position, wherein said catch member moves pivotally about an axis of rotation, said solenoid shaft has a longitudinal axis, and said axis of rotation of said catch member is parallel to said longitudinal axis of said solenoid shaft, wherein the electromechanical keeper further comprises a receptacle adapted to matingly receive a matching jack for the connection of control signal lines using the matching jack to thereby provide control signals to said solenoid, and wherein said catch member is in the shape of a rectangular parallelepiped having an elongated cylinder joined to it, said elongated cylinder and said rectangular parallelepiped each having a longitudinal axis, said elongated cylinder being joined to said rectangular parallelepiped with said longitudinal axis of said rectangular parallelepiped being parallel to said longitudinal axis of said elongated cylinder.

2. The electromechanical keeper according to claim 1, further comprising a compression spring that acts to bias said solenoid shaft toward said extended position.

3. The electromechanical keeper according to claim 1, further comprising a torsion spring, said torsion spring biasing said catch member toward said closed position.

4. The electromechanical keeper according to claim 1, further comprising a pivot pin passing through a bore in said catch member to thereby pivotally connect said catch member to said base plate.

5. The electromechanical keeper according to claim 1, wherein said rectangular parallelepiped forms a pawl-engaging portion of said catch member.

6. The electromechanical keeper according to claim 5, wherein a portion of said catch member that is formed by said elongated cylinder has a longitudinal bore, and wherein the electromechanical keeper further comprises a pivot pin passing through said longitudinal bore in said catch member to thereby pivotally connect said catch member to said base plate.

7. The electromechanical keeper according to claim 6, wherein said base plate has a pair of pillars that are spaced apart from one another, each of said pillars has a first bore, said first bore in each of said pair of pillars is in alignment with said first bore in the other of said pair of pillars, said catch member fits between said pair of pillars such that said longitudinal bore of said catch member is in alignment with said first bore of each of said pair of pillars, and wherein said pivot pin is positioned through said longitudinal bore of said catch member and the first bore in each of said pair of pillars in order to pivotally connect said catch member to said base plate.

8. The electromechanical keeper according to claim 7, further comprising a torsion spring, said torsion spring having coils, said torsion spring biasing said catch member toward said closed position, wherein said portion of said catch member that is formed by said elongated cylinder is longer than said pawl-engaging portion of said catch member thereby forming a cylindrical projection, and wherein said coils of said torsion spring are positioned around said cylindrical projection.

9. The electromechanical keeper according to claim 8, wherein said catch member has a notch and said torsion spring has a first arm and a second arm, said base plate has a flat plate portion, said first arm of said torsion spring is positioned in said notch of said catch member, and said second arm of said torsion spring is positioned in an angle between one of said pair of pillars and said flat plate portion of said base plate.

10. The electromechanical keeper according to claim 7, wherein said catch member has a second projection that abuts one of said pair of pillars when said catch member is in said closed position to thereby prevent the catch member from overshooting said closed position as said catch member rotates toward said closed position.

11. The electromechanical keeper according to claim 7, wherein one of said pillars has a second bore that is parallel to, but spaced apart from, said first bore of said one of said pillars, said second bore is in alignment with said cavity in said catch member when said catch member is in said closed position.

12. The electromechanical keeper according to claim 11, wherein said solenoid has a body, and when said solenoid is energized said solenoid shaft linearly moves relative to said solenoid body from said extended position to said retracted position.

13. The electromechanical keeper according to claim 12, wherein said solenoid shaft includes an annular flange, and wherein the electromechanical keeper further comprises a compression spring provided intermediate said flange and said solenoid body such that said compression spring acts to bias said solenoid shaft toward said extended position.

14. The electromechanical keeper according to claim 13, wherein with said solenoid body secured to said base plate, said solenoid shaft will be in alignment with said second bore and said solenoid shaft will be in alignment with said cavity in said catch member when said catch member is in said closed position, such that when said catch member is in said closed position and said solenoid shaft is in said extended position, said solenoid shaft engages said cavity in said catch member to thereby prevent any rotational movement of said catch member toward said open position, and such that when said solenoid is energized, said solenoid shaft is retracted to said retracted position wherein said solenoid shaft is completely withdrawn from said cavity in said catch member to thereby free said catch member for rotation toward said open position.

15. The electromechanical keeper according to claim 1, wherein the underlying surface is a flat surface and the electromechanical keeper is adapted to be surface-mountable such that it can be mounted to the flat surface without requiring a recess in the flat surface, and at most the only preparation of the flat surface that is required is the provision of holes in the flat surface for engagement of fasteners used for mounting said base plate to the flat surface.

16. The electromechanical keeper according to claim 1, wherein power is provided to the electromechanical keeper via power lines, and wherein said receptacle is adapted for the connection of both the power lines and the control signal lines with both the power lines and the control signal lines being carried by the same matching jack.

17. The electromechanical keeper according to claim 1, wherein said base plate can be mounted to the flat surface by using means selected from the group consisting of adhesives, welding, soldering, brazing, and fasteners.

18. The electromechanical keeper according to claim 1, wherein said base plate has a flat plate portion, and said flat plate portion is provided with mounting holes for engagement by appropriate fasteners.

19. The electromechanical keeper according to claim 1, further comprising a protective cover that covers said receptacle and said solenoid body, said protective cover preventing corrosion and foreign matter from interfering with the operation of the electromechanical keeper.

20. The electromechanical keeper according to claim 19, wherein said protective cover is secured in place by providing a snap-fit between said protective cover and said base plate.

21. The electromechanical keeper according to claim 1, wherein said solenoid is operated with a 25% duty cycle to prevent said solenoid from overheating.

22. The electromechanical keeper according to claim 1, wherein the electromechanical keeper is used to secure a door in the closed position and wherein the electromechanical keeper further comprises a circuit board and a micro-switch, said micro-switch is positioned such that it is actuated by said solenoid shaft when said solenoid shaft reaches said retracted position, said micro-switch communicates with said circuit board, said circuit board also communicates with said solenoid and said receptacle, said micro-switch is actuated by said solenoid shaft when said solenoid shaft reaches said retracted position to generated a signal that indicates a time when energizing of said solenoid was initiated, said solenoid being controlled by said circuit board such that said solenoid is energized for a first predetermined period of time to allow the door to be opened and then said solenoid is not energized again within a following second predetermined period of time to prevent overheating of said solenoid.

23. The electromechanical keeper according to claim 22, wherein said first predetermined period of time is 10 seconds and said second predetermined period of time is 30 seconds.

24. The electromechanical keeper according to claim 1, wherein said catch member has a pawl-engaging portion and a shelf projecting outward from said catch member substantially perpendicularly relative to said pawl-engaging portion of said catch member, such that when said catch member is in said open position, said shelf is approximately in a position occupied by said pawl-engaging portion when said catch member is in said closed position.

25. The electromechanical keeper according to claim 4, wherein said catch member is provided with an elongated catch portion having a hook-like end portion, said elongated catch portion extends parallel to said base plate when said catch member is in said closed position, and said pivot pin is positioned intermediate said base plate and said elongated catch portion when said catch member is in said closed position.

26. The electromechanical keeper according to claim 1, wherein said catch member is provided with an elongated catch portion having a bend so as to have an L-shaped profile, and said elongated catch portion has a hook-like end portion.

27. The electromechanical keeper according to claim 26, wherein said elongated catch portion initially extends parallel to said base plate and then bends at about a right angle in a direction toward a plane defined by said base plate when said catch member is in said closed position.

28. An electromechanical keeper comprising:

a base plate adapted for being mounted to a surface;

a catch member pivotally supported by said base plate, said catch member being movable between open and closed positions, said catch member being adapted to engage a latch pawl of a latch when said catch member is in said closed position and said catch member not being engageable by the latch pawl when said catch member is in said open position, said catch member having a cavity, said catch member moving pivotally about an axis of rotation, said catch member being in the shape of a rectangular parallelepiped having an elongated cylinder joined to it, said elongated cylinder and said rectangular parallelepiped each having a longitudinal axis, said elongated cylinder being joined to said rectangular parallelepiped with said longitudinal axis of said rectangular parallelepiped being parallel to said longitudinal axis of said elongated cylinder, said rectangular parallelepiped forming a pawl-engaging portion of said catch member;

a torsion spring, said torsion spring biasing said catch member toward said closed position, said torsion spring having coils, wherein said portion of said catch member that is formed by said elongated cylinder is longer than said pawl-engaging portion of said catch member thereby forming a cylindrical projection, and wherein said coils of said torsion spring are positioned around said cylindrical projection; and a solenoid supported by said base plate, said solenoid having a solenoid shaft that is movable from an extended position to a retracted position responsive to said solenoid being energized, said solenoid shaft having a longitudinal axis, said solenoid shaft engaging said cavity in said catch member to thereby retain said catch member in said closed position when said solenoid shaft is in said extended position, said solenoid shaft being disengaged from said cavity in said catch member such that said catch member is free to move from said closed position to said open position when said solenoid shaft is in said retracted position.

29. The electromechanical keeper according to claim 28, further comprising a compression spring that acts to bias said solenoid shaft toward said extended position.

30. The electromechanical keeper according to claim 28, wherein a portion of said catch member that is formed by said elongated cylinder has a longitudinal bore, and wherein the electromechanical keeper further comprises a pivot pin passing through said longitudinal bore in said catch member to thereby pivotally connect said catch member to said base plate.

31. The electromechanical keeper according to claim 30, wherein said base plate has a pair of pillars that are spaced apart from one another, each of said pillars has a first bore, said first bore in each of said pair of pillars is in alignment with said first bore in the other of said pair of pillars, said catch member fits between said pair of pillars such that said longitudinal bore of said catch member is in alignment with said first bore of each of said pair of pillars, and wherein said pivot pin is positioned through said longitudinal bore of said catch member and the first bore in each of said pillars in order to pivotally connect said catch member to said base plate.

32. The electromechanical keeper according to claim 31, wherein said catch member has a notch and said torsion spring has a first arm and a second arm, said base plate has a flat plate portion, said first arm of said torsion spring is positioned in said notch of said catch member, and said second arm of said torsion spring is positioned in an angle between one of said pair of pillars and said flat plate portion of said base plate.

33. The electromechanical keeper according to claim 32, wherein said catch member has a second projection that abuts one of said pair of pillars when said catch member is in said closed position to thereby prevent the catch member from overshooting said closed position as said catch member rotates toward said closed position.

34. The electromechanical keeper according to claim 32, wherein one of said pair of pillars has a second bore that is parallel to, but spaced apart from, said first bore of said one of said pair of pillars, said second bore is in alignment with said cavity in said catch member when said catch member is in said closed position.

35. The electromechanical keeper according to claim 34, wherein said solenoid has a body, and when said solenoid is energized said solenoid shaft linearly moves relative to said solenoid body from said extended position to said retracted position, and wherein with said solenoid body secured to said base plate, said solenoid shaft will be in alignment with said second bore and said solenoid shaft will be in alignment with said cavity in said catch member when said catch member is in said closed position, such that when said catch member is in said closed position and said solenoid shaft is in said extended position, said solenoid shaft engages said cavity in said catch member to thereby prevent any rotational movement of said catch member toward said open position, and such that when said solenoid is energized, said solenoid shaft is retracted to said retracted position wherein said solenoid shaft is completely withdrawn from said cavity in said catch member to thereby free said catch member for rotation toward said open position.

36. The electromechanical keeper according to claim 28, wherein the electromechanical keeper further comprises a receptacle for the connection of control signal lines using a matching jack to thereby provide control signals to said solenoid.

37. The electromechanical keeper according to claim 36, wherein power is provided to the electromechanical keeper via power lines, and wherein said receptacle is adapted for the connection of both the power lines and the control signal lines with both the power lines and the control signal lines being carried by the same matching jack.

38. The electromechanical keeper according to claim 37, wherein said solenoid has a body, further comprising a protective cover that covers said receptacle and said solenoid body, said protective cover preventing corrosion and foreign matter from interfering with the operation of the electromechanical keeper.

39. The electromechanical keeper according to claim 38, wherein said protective cover is secured in place by providing a snap-fit between said protective cover and said base plate.

40. The electromechanical keeper according to claim 28, wherein said solenoid is operated with a 25% duty cycle to prevent said solenoid from overheating.

41. The electromechanical keeper according to claim 28, wherein the electromechanical keeper is used to secure a door in the closed position and wherein the electromechanical keeper further comprises a circuit board and a micro-switch, said micro-switch is positioned such that it is actuated by said solenoid shaft when said solenoid shaft reaches said retracted position, said micro-switch communicates with said circuit board, said circuit board also communicates with said solenoid and said receptacle, said micro-switch is actuated by said solenoid shaft when said solenoid shaft reaches said retracted position to generated a signal that indicates a time when energizing of said solenoid was initiated, said solenoid being controlled by said circuit board such that said solenoid is energized for a first predetermined period of time to allow the door to be opened and then said solenoid is not energized again with a following second predetermined period of time to prevent overheating of said solenoid.

42. The electromechanical keeper according to claim 41, wherein said first predetermined period of time is 10 seconds and said second predetermined period of time is 30 seconds.

43. The electromechanical keeper according to claim 28, wherein said catch member has a shelf projecting outward from said catch member substantially perpendicularly relative to said pawl-engaging portion of said catch member, such that when said catch member is in said open position, said shelf is approximately in a position occupied by said pawl-engaging portion when said catch member is in said closed position.

44. The electromechanical keeper according to claim 28, wherein said axis of rotation of said catch member is parallel to said longitudinal axis of said solenoid shaft.

45. An electromechanical keeper comprising:

a base plate adapted for being mounted to a surface, said base plate having a pair of pillars that are spaced apart from one another, each of said pillars having a first bore, said first bore in each of said pair of pillars being in alignment with said first bore in the other of said pair of pillars;

a catch member pivotally supported by said base plate, said catch member being movable between open and closed positions, said catch member being adapted to engage a latch pawl of a latch when said catch member is in said closed position and said catch member not being engageable by the latch pawl when said catch member is in said open position, said catch member having a cavity, said catch member moving pivotally about an axis of rotation, said catch member having a longitudinal bore;

a pivot pin passing through said longitudinal bore in said catch member to thereby pivotally connect said catch member to said base plate, wherein said catch member fits between said pair of pillars such that said longitudinal bore of said catch member is in alignment with said first bore of each of said pair of pillars, wherein said pivot pin is positioned through said longitudinal bore of said catch member and the first bore in each of said pair of pillars in order to pivotally connect said catch member to said base plate, and wherein said catch member has a projection that abuts one of said pair of pillars when said catch member is in said closed position to thereby prevent the catch member from overshooting said closed position as said catch member rotates toward said closed position; and a solenoid supported by said base plate, said solenoid having a solenoid shaft that is movable from an extended position to a retracted position responsive to said solenoid being energized, said solenoid shaft having a longitudinal axis, said solenoid shaft engaging said cavity in said catch member to thereby retain said catch member in said closed position when said solenoid shaft is in said extended position, said solenoid shaft being disengaged from said cavity in said catch member such that said catch member is free to move from said closed position to said open position when said solenoid shaft is in said retracted position.

46. The electromechanical keeper according to claim 45, further comprising a compression spring that acts to bias said solenoid shaft toward said extended position.

47. The electromechanical keeper according to claim 45, further comprising a torsion spring, said torsion spring biasing said catch member toward said closed position, wherein said catch member has a notch and said torsion spring has a first arm and a second arm, said base plate has a flat plate portion, said first arm of said torsion spring is positioned in said notch of said catch member, and said second arm of said torsion spring is positioned in an angle between one of said pillars and said flat plate portion of said base plate.

48. The electromechanical keeper according to claim 45, wherein one of said pair of pillars has a second bore that is parallel to, but spaced apart from, said first bore of said one of said pair of pillars, said second bore is in alignment with said cavity in said catch member when said catch member is in said closed position.

49. The electromechanical keeper according to claim 48, wherein said solenoid has a body, and when said solenoid is energized said solenoid shaft linearly moves relative to said solenoid body from said extended position to said retracted position, and wherein with said solenoid body secured to said base plate, said solenoid shaft will be in alignment with said second bore and said solenoid shaft will be in alignment with said cavity in said catch member when said catch member is in said closed position, such that when said catch member is in said closed position and said solenoid shaft is in said extended position, said solenoid shaft engages said cavity in said catch member to thereby prevent any rotational movement of said catch member toward said open position, and such that when said solenoid is energized, said solenoid shaft is retracted to said retracted position wherein said solenoid shaft is completely withdrawn from said cavity in said catch member to thereby free said catch member for rotation toward said open position.

50. The electromechanical keeper according to claim 45, wherein the electromechanical keeper further comprises a receptacle for the connection of control signal lines using a matching jack to thereby provide control signals to said solenoid.

51. The electromechanical keeper according to claim 50, wherein power is provided to the electromechanical keeper via power lines, and wherein said receptacle is adapted for the connection of both the power lines and the control signal lines with both the power lines and the control signal lines being carried by the same matching jack.

52. The electromechanical keeper according to claim 51, wherein said solenoid has a body, further comprising a protective cover that covers said receptacle and said solenoid body, said protective cover preventing corrosion and foreign matter from interfering with the operation of the electromechanical keeper.

53. The electromechanical keeper according to claim 52, wherein said protective cover is secured in place by providing a snap-fit between said protective cover and said base plate.

54. The electromechanical keeper according to claim 45, wherein said solenoid is operated with a 25% duty cycle to prevent said solenoid from overheating.

55. The electromechanical keeper according to claim 45, wherein the electrochemical keeper is used to secure a door in the closed position and wherein the electrochemical keeper further comprises a circuit board and a micro-switch, said micro-switch is positioned such that it is actuated by said solenoid shaft when said solenoid shaft reaches said retracted position, said micro-switch communicates with said circuit board, said circuit board also communicates with said solenoid and said receptacle, said micro-switch is actuated by said solenoid shaft when said solenoid shaft reaches said retracted position to generated a signal that indicates a time when energizing of said solenoid was initiated, said solenoid being controlled by said circuit board such that said solenoid is energized for a first predetermined period of time to allow the door to be opened and then said solenoid is not energized again within a following second predetermined period of time to prevent overheating of said solenoid.

56. The electromechanical keeper according to claim 55, wherein said first predetermined period of time is 10 seconds and said second predetermined period of time is 30 seconds.

57. The electromechanical keeper according to claim 45, wherein said catch member has a pawl-engaging portion and a shelf projecting outward from said pawl-engaging portion of said catch member substantially perpendicularly relative to said pawl-engaging portion of said catch member, such that when said catch member is in said open position, said shelf is approximately in a position occupied by said pawl-engaging portion when said catch member is in said closed position.

58. The electromechanical keeper according to claim 45, wherein said axis of rotation of said catch member is parallel to said longitudinal axis of said solenoid shaft.

59. An electromechanical keeper for use in securing a door in the closed position, the electromechanical keeper comprising:

a base plate adapted for being mounted to a surface;

a catch member pivotally supported by said base plate, said catch member being movable between open and closed positions, said catch member being adapted to engage a latch pawl of a latch when said catch member is in said closed position and said catch member not being engageable by the latch pawl when said catch member is in said open position, said catch member having a cavity, said cavity member moving pivotally about an axis of rotation;

a solenoid supported by said base plate, said solenoid having a solenoid shaft that is movable from an extended position to a retracted position responsive to said solenoid being energized, said solenoid shaft having a longitudinal axis, said solenoid shaft engaging said cavity in said catch member to thereby retain said catch member in said closed position when said solenoid shaft is in said extended position, said solenoid shaft being disengaged from said cavity in said catch member such that said catch member is free to move from said closed position to said open position when said solenoid shaft is in said retracted position;

a receptacle for the connection of control signal lines using a matching jack to thereby provide control signals to said solenoid;

a circuit board; and a micro-switch, said micro-switch being positioned such that it is actuated by said solenoid shaft when said solenoid shaft reaches said retracted position, said micro-switch communicating with said circuit board, said circuit board also communicating with said solenoid and said receptacle, said micro-switch being actuated by said solenoid shaft when said solenoid shaft reaches said retracted position to generate a signal that indicates a time when energizing of said solenoid was initiated, said solenoid being controlled by said circuit board such that said solenoid is energized for a first predetermined period of time to allow the door to be opened and than said solenoid is not energized again within a following second predetermined period of time to prevent overheating of said solenoid.

60. The electromechanical keeper according to claim 59, wherein said first predetermined period of time is 10 seconds and said second predetermined period of time is 30 seconds.

61. The electromechanical keeper according to claim 59, wherein said solenoid is operated with a 25% duty cycle to prevent said solenoid from overheating.

62. The electromechanical keeper according to claim 59, wherein power is provided to the electromechanical keeper via power lines, and wherein said receptacle is adapted for the connection of both the power lines and the control signal lines with both the power lines and the control signal lines being carried by the same matching jack.

63. The electromechanical keeper according to claim 59, wherein said axis of rotation of said catch member is parallel to said longitudinal axis of said solenoid shaft.

64. A method of operating an electromechanical keeper for use in securing a door in the closed position comprising the steps of:

Providing an electromechanical keeper comprising:

a base plate adapted for being mounted to a surface;

a catch member pivotally supported by said base plate, said catch member being movable between open and closed positions, said catch member being adapted to engage a latch pawl of a latch when said catch member is in said closed position and said catch member not being engageable by the latch pawl when said catch member is in said open position, said catch member having a cavity, said catch member moving pivotally about an axis of rotation;

a solenoid supported by said base plate, said solenoid having a solenoid shaft that is movable from an extended position to a retracted position responsive to said solenoid being energized, said solenoid shaft having a longitudinal axis, said solenoid shaft engaging said cavity in said catch member to thereby retain said catch member in said closed position when said solenoid shaft is in said extended position, said solenoid shaft being disengaged from said cavity in said catch member such that said catch member is free to move from said closed position to said open position when said solenoid shaft is in said retracted position;

a circuit board; and a micro-switch, said micro-switch being positioned such that it is actuated by said solenoid shaft when said solenoid shaft reaches said retracted position;

monitoring a signal generated when said micro-switch is actuated by said solenoid shaft reaching said retracted position that indicates a time when energizing of said solenoid was initiated;

controlling said solenoid by said circuit board such that said solenoid is energized for a first predetermined period of time to allow the door to be operated; and controlling said solenoid by said circuit board such that subsequently said solenoid is not energized again within a following second predetermined period of time.

65. The method according to claim 64, wherein said first predetermined period of time is 10 seconds and said second predetermined period of time is 30 seconds.

* * * * *